US009121564B2

(12) United States Patent
Buisson

(10) Patent No.: US 9,121,564 B2
(45) Date of Patent: Sep. 1, 2015

(54) DEVICE FOR PROCURING AN INFINITY EFFECT FOR A MOTOR VEHICLE SIGNALING LIGHT

(75) Inventor: Alain Buisson, Trappes (FR)

(73) Assignee: AUTOMOTIVE LIGHTING REAR LAMPS FRANCE S.A.S., Saint-Julien du Sault (FR)

( * ) Notice: Subject to any disclaimer, the term of this patent is extended or adjusted under 35 U.S.C. 154(b) by 0 days.

(21) Appl. No.: 13/636,043

(22) PCT Filed: Mar. 18, 2011

(86) PCT No.: PCT/EP2011/054145

§ 371 (c)(1),
(2), (4) Date: Sep. 19, 2012

(87) PCT Pub. No.: WO2011/113937

PCT Pub. Date: Sep. 22, 2011

(65) Prior Publication Data

US 2013/0010487 A1 Jan. 10, 2013

(30) Foreign Application Priority Data

Mar. 19, 2010 (FR) ..... 10 01084

(51) Int. Cl.

| | |
|---|---|
| ***F21S 8/10*** | (2006.01) |
| ***F21V 7/00*** | (2006.01) |
| *F21W 101/08* | (2006.01) |
| *F21Y 101/02* | (2006.01) |
| *F21Y 113/02* | (2006.01) |

(52) U.S. Cl.

CPC ..... *F21S 48/215* (2013.01); *F21S 48/115* (2013.01); *F21S 48/23* (2013.01); *F21V 7/0025* (2013.01); *F21W 2101/08* (2013.01); *F21Y 2101/02* (2013.01); *F21Y 2113/02* (2013.01)

(58) Field of Classification Search

CPC ..... F21S 48/215
USPC ..... 362/516, 811, 298–301, 346
See application file for complete search history.

(56) References Cited

U.S. PATENT DOCUMENTS

| | | | | |
|---|---|---|---|---|
| 5,787,618 | A * | 8/1998 | Mullis | 40/219 |
| 7,029,152 | B1 * | 4/2006 | Kuhl | 362/489 |
| 2003/0086276 | A1 * | 5/2003 | Ohtsuka et al. | 362/511 |
| 2005/0078486 | A1 * | 4/2005 | Kawaguchi | 362/494 |

FOREIGN PATENT DOCUMENTS

| | | | |
|---|---|---|---|
| DE | 10207694 | A1 | 11/2003 |
| DE | 102008029450 | A1 | 12/2009 |
| EP | 1434000 | A2 | 6/2004 |
| EP | 1916471 | A1 | 4/2008 |
| EP | 2071232 | A1 | 6/2009 |
| FR | 2953781 | A1 | 12/2009 |
| WO | 2011070161 | A1 | 6/2011 |

OTHER PUBLICATIONS

Jun. 22, 2011 International Search Report and Written Opinion for PCT/EP2011/054145.

* cited by examiner

*Primary Examiner* — Mary Ellen Bowman
(74) *Attorney, Agent, or Firm* — Howard & Howard Attorneys PLLC

(57) ABSTRACT

A device and corresponding module are for a signaling light and/or lighting an exterior or interior ambient of a motor-vehicle passenger compartment including a type of light source. The device comprises an optical assembly of a first reflector including a mirror and a second reflector including a semi-transparent mirror. Light emitted by an LED is diffused in a curtain diffuser of a transparent material. Planes or mid-planes of the mirror, the semi-transparent mirror, and the diffuser are mutually parallel. Light transmitted or reflected by the assembly is transmitted and visible to an observer from a surface of the second reflector that is opposite to that facing other elements of the assembly. The diffuser includes a lighting sub-assembly arranged in space between the mirror and semi-transparent mirror and having a transparent optical material and a light source arranged for emission of light rays propagated within a thickness of the optical material.

17 Claims, 8 Drawing Sheets

A

DEVICE FOR PROCURING AN INFINITY EFFECT FOR A MOTOR VEHICLE SIGNALING LIGHT

CROSS-REFERENCE TO RELATED APPLICATIONS

This application is a "national phase" application based upon International Patent Application PCT/BP2011/054145 filed on Mar. 18, 2011 and entitled "Device for Procuring an Infinity Effect for a Motor Vehicle Signaling light," which, in turn, claims priority to and benefit of the filing date of French Patent Application 10/01084 filed on Mar. 19, 2010 and entitled "Device for Procuring an Infinity Effect for a Motor Vehicle Signaling Light."

BACKGROUND OF INVENTION

1. Field of the Invention

The invention relates to, in general, the field of lighting for signaling and/or "ambient illumination" functions m vehicles (specifically; motor vehicles) and, in particular, a device for procuring a "relief" effect in the illumination of signaling lights and/or lights for the exterior or interior fighting of vehicles.

2. Description of Related Art

Efforts are increasingly being directed toward the maximum possible reduction of the volume of housings for the accommodation of sets or sub-sets of the signaling lights that are fitted to motor vehicles as a statutory requirement. This objective is facilitated by the use of LEDs in place of or in addition to conventional lamps.

By definition, it might appear contradictory to simultaneously pursue the objective of lending depth (specifically, an impression of relief) to the light generated by signaling-light housings with this reduced volume.

From other fields (specifically, interior decoration in domestic or professional settings), systems are known for the reflection of light by mirrors arranged opposite each other, thus creating an impression of infinity by the successive reflection of the image of the location concerned from one mirror to the other. The images thus obtained, which create an impression of infinity, use fully-reflective mirrors and create an impression that does not vary substantially, regardless of whether the observer is positioned close to or at a distance from one of the mirrors concerned. The light sources used are all positioned in front of at least one of the mirrors while the observer is positioned in a space between the two mirrors.

Thus, there is a need in the related art for a device that generates an "infinity" effect in the signaling and/or ambient lighting of motor vehicles. There is a need in the related art also for such a device that permits the addition of "style" effects to the signaling lights of vehicles.

SUMMARY OF INVENTION

The invention overcomes the disadvantages in the related art in a device for a signaling light and/or lighting an exterior or interior ambient of a motor-vehicle passenger compartment including at least one type of light source. The device comprises an optical assembly of at least one first reflector including a mirror and at least one second reflector including a semi-transparent mirror. Light emitted by at least one LED is diffused in a curtain diffuser of a substantially transparent material. A plurality of planes or mid-planes of the mirror, the semi-transparent mirror, and the curtain diffuser are mutually substantially parallel. Light transmitted or reflected by the optical assembly is transmitted and visible to an observer from a surface of the second reflector that is substantially opposite to that facing a plurality of other elements of the optical assembly. The curtain diffuser includes a lighting sub-assembly arranged in space between the mirror and semi-transparent mirror and having a substantially transparent optical material and at least one light source arranged for emission of a plurality of rays of light propagated within a thickness of the transparent optical material.

The invention overcomes the disadvantages in the related art in also a signaling and/or lighting module for an exterior or interior of a motor vehicle, wherein the module comprises at least one of the device. The module is integrated or suitable for integration in an assembly comprising all the oilier functional elements required.

The optical assembly is, in an embodiment, integrated or suitable for integration in a housing (for example, in the general form of a cylindrical section) to constitute a module.

In the optical assembly, the second reflector (R2) and, optionally, the curtain diffuser (D1) are arranged in front of the LED or LEDs.

In an embodiment, the device comprises a lighting sub-assembly arranged in the space between the mirror and semi-transparent mirror, transparent optical material, and at least one light source of the "LED" type arranged for the emission of the rays of light propagated within the material thickness of the transparent optical material [in accordance with French Patent Application 09/05984 filed on Dec. 11, 2009 in the name of the applicant (the description of which in full is included herein by reference)]. In brief a sub-assembly of this type essentially comprises a plate of a transparent optical material forming a curtain. The plate comprises at least one bilateral and extended convex projection of substantially circular overall cross-section having its median longitudinal axis in the mid-plane of the plate and adapted to form a light guide and at least one LED arranged m at least one end of the light guide and having its main orthogonal axis in the longitudinal axis of the light guide.

The respective planes or mid-planes of the mirror and semi-transparent mirror(s) are substantially mutually parallel.

However, it is conceivable for the respective planes or mid-planes of the mirror and semi-transparent mirror(s) to enclose an angle substantially ranging from 1 to 3 degrees. This allows a spatial variability of the images from specific light sources, thereby delivering an even more original "style" effect.

In advantageous embodiments of the invention, one or other(s) of the following features/arrangements may be applied, either separately or in combination.

The optical assembly is arranged perpendicularly or substantially perpendicularly to the optical axis of the beam emitted by the LED or LEDs.

The median direction of emission of the LEDs is parallel to the optical axis of the module.

The mirror (R1) is arranged substantially on the level of the LEDs with its reflective surface facing the front whereas the mirror (R1) is hollowed-out or non-existent at the level of the LEDs to allow the latter to project their light beam in front of the mirror (R1).

The mirror (R1) is a semi-transparent mirror identical to or different than that constituting the second reflector (R2). In this embodiment, the LEDs are provided with reflectors.

The curtain (D1) is combined with the mirror (R1).

The mirror (R1) is selected from reflectors, mirrors proper, or semi-mirrors and may be plane, conical, elliptical, semi-elliptical, hyperbolic, spiral, logarithmic spiral, helical, or other.

The mirror (R1) may show variable curvature, including variations between/among different zones within the same mirror. For example, it may be plane throughout its central section and spherical at its periphery.

The mirror (R1) may show a colored appearance when the LEDs are extinguished—for example, if a metal other than aluminum is used in the process for deposition under argon.

At least one LED is arranged in a central position in the module and, in combination with a curtain that is combined with the mirror (R1), delivers a "relief" effect or reverse "infinity" effect, which is particularly useful for indicating the illumination of a brake light.

The reflective surface of the semi-transparent mirror (R2) or, optionally, (R1) may be achieved by: a) application of a semi-transparent film; b) direct metal-plating (e.g., of aluminum or other metals by spattering); or c) deposition of a thin plating to a transparent glass or screen, which allows the differentiation of colors while maintaining a semi-transparent quality ("a" is suitable for plane surfaces while "b" has the advantage of suitability for application to plane and complex surfaces).

The semi-transparent mirror (R2) or, optionally, (R1) may be of the "clear" type or, conversely, colored—for example, amber, yellow, fluorescent green, "police" blue, a combination of red light with a green transparent material, or a "smoked" material, which gives a black appearance when the lighting is extinguished and red appearance when it is illuminated.

There is a ratio between, the transparency and transmission of the semi-transparent mirror, and, in accordance with the objective to be achieved [higher or lower photometric performance or greater or lesser depth ("style" effect)], these coefficients may be easily adjusted by the person ordinarily skilled in the related art.

The module shows a colored appearance—for example, red (either when it is extinguished or illuminated or illuminated only).

In an embodiment, an additional optical system is added between the two mirrors (R1), (R2), providing a light source that is parallel to the other light sources for the provision of a signaling light.

The device fulfills the statutory function of a side light with an initial ring of LEDs arranged in a circle around a central point and brake light delivering a stronger intensity and a "relief" effect from its base.

The assembly or a sub-assembly thereof may be driven electronically [e.g., by a resistance system or PWM (pulse-wave modulation), which varies the current frequency within a range of 80-150 Hz and allows a variation of luminous intensity for the delivery of alternative "brake light" and "side light" functions].

The central ring is only illuminated when the brake is depressed.

At least one of the mirrors (R1), (R2) is spherical, which maintains the effect of depth or infinity within a range of 20-30 m. The number of repetitions visible to the human eye is then dependent upon, the intensity of the light source.

The device is designed to deliver the repetition of a light motif between a mirror (reflection. "R"=100%) and semi-transparent mirror (reflection "R"≈50% and transmission "T"≈50%).

The stylistic appearance with "depth" effect delivered by the device has the appearance of dots or a line, whether continuous or in another form.

The LEDs are arranged at the periphery and/or in the center of the module. The LEDs deliver their light directly or through the section of a curtain.

A curtain is incorporated between the two mirrors (R1), (R2) to create an illuminated form that is reflected, a number of times.

For the delivery of an even more spectacular "lighting" effect the curtain is provided with a chamfered opening at its periphery.

Via one or more of its sections, the curtain receives light from a number of LEDs advantageously combined in one PCB or more PCBs.

The surface of the mirror (R1) is non-continuous or perforated at the point of arrangement of the LEDs advantageously in a peripheral position and/or centrally in a circular or substantially circular module.

The LEDs may be replaced or supplemented by 16-W axial-filament lamps.

The module housing may be configured in any form (e.g. circular, elliptical, square, etc.) or a specific form for the delivery of a "signature" design.

The semi-transparent mirror (R2) may constitute the protective window for the module. In an embodiment, this window is added in the conventional manner.

In an embodiment, the outer periphery of the device may be provided with a shoulder, thereby emphasizing the outline of the light.

The end of the light guide (or "curtain") opposite the end that is equipped with at least one LED may be provided with a cover for the masking from vision of any light that may escape from the periphery of the curtain with a reflective component (in an embodiment, of metal construction) or chamfers and/or prisms.

Other objects, features, and advantages of the invention are readily appreciated as the same becomes better understood while the subsequent detailed description of embodiments of the invention is read taken in conjunction with the accompanying drawing thereof.

BRIEF DESCRIPTION OF EACH FIGURE OF DRAWING OF INVENTION

FIG. 1 shows a schematic view with an "observation" point that lies in the optical axis of one of the LEDs.

Figure 7:
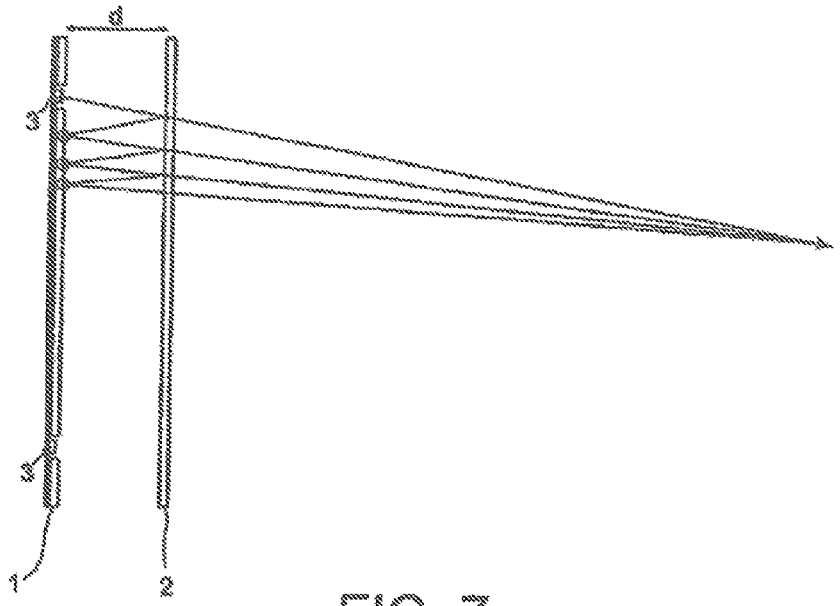
Figure 8:
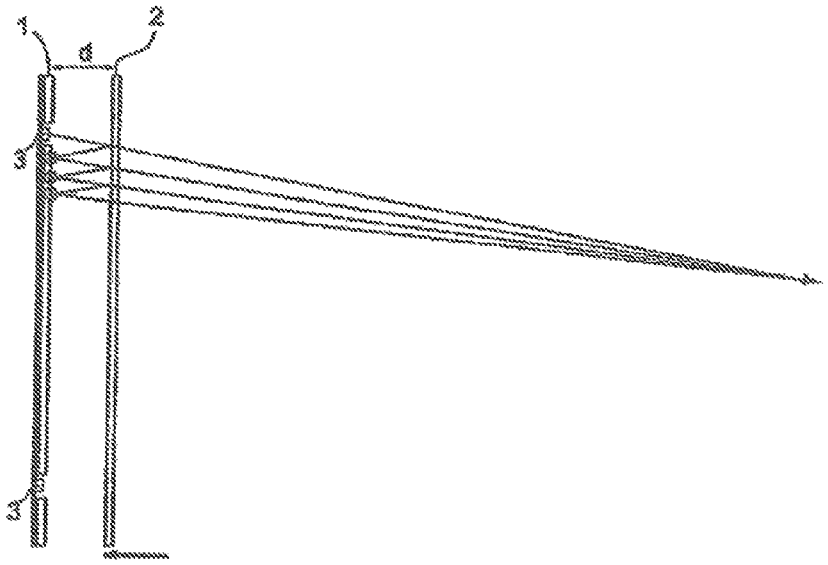
Figure 9:
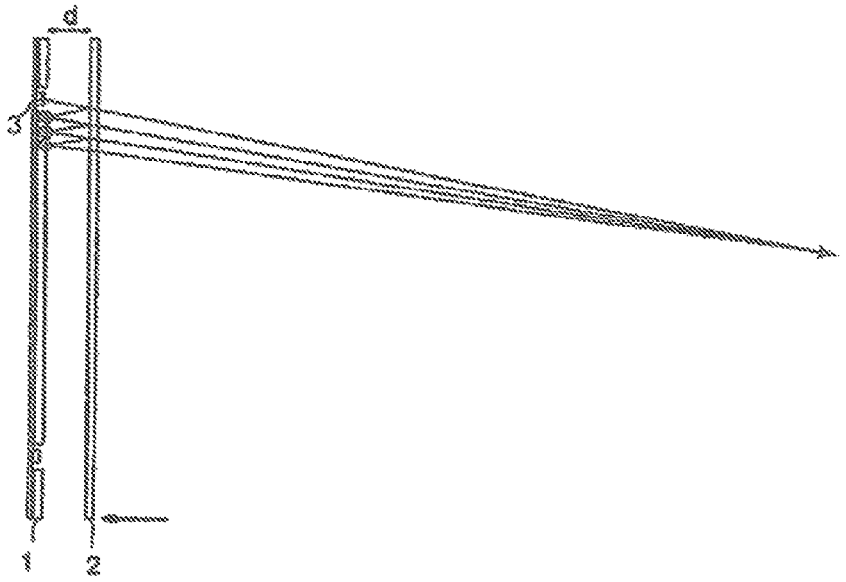

FIGS. 7, 8, and 9 show schematic representations of the variation in the distances between the images seen by the eye of the observer when the distance "d" between the two mirrors 1, 2 is varied.

Figure 10:
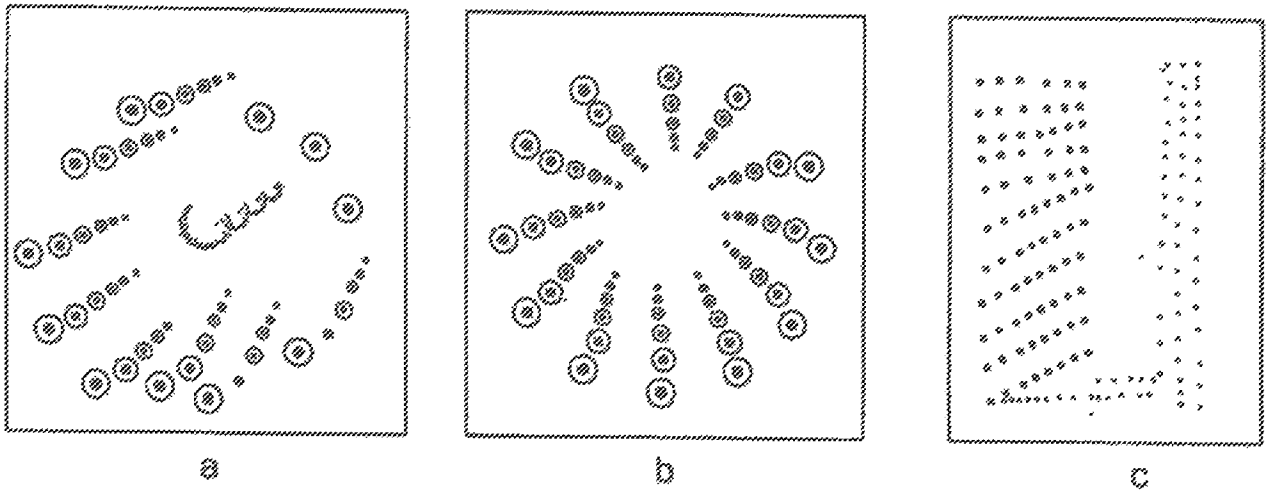

FIG. 10 shows all the images seen by an observer using a: a) plane mirror 1, twelve peripheral light sources, and one central light source; b) spherical mirror 1; and c) plane mirror 1 with an interposed curtain.

Figure 11:
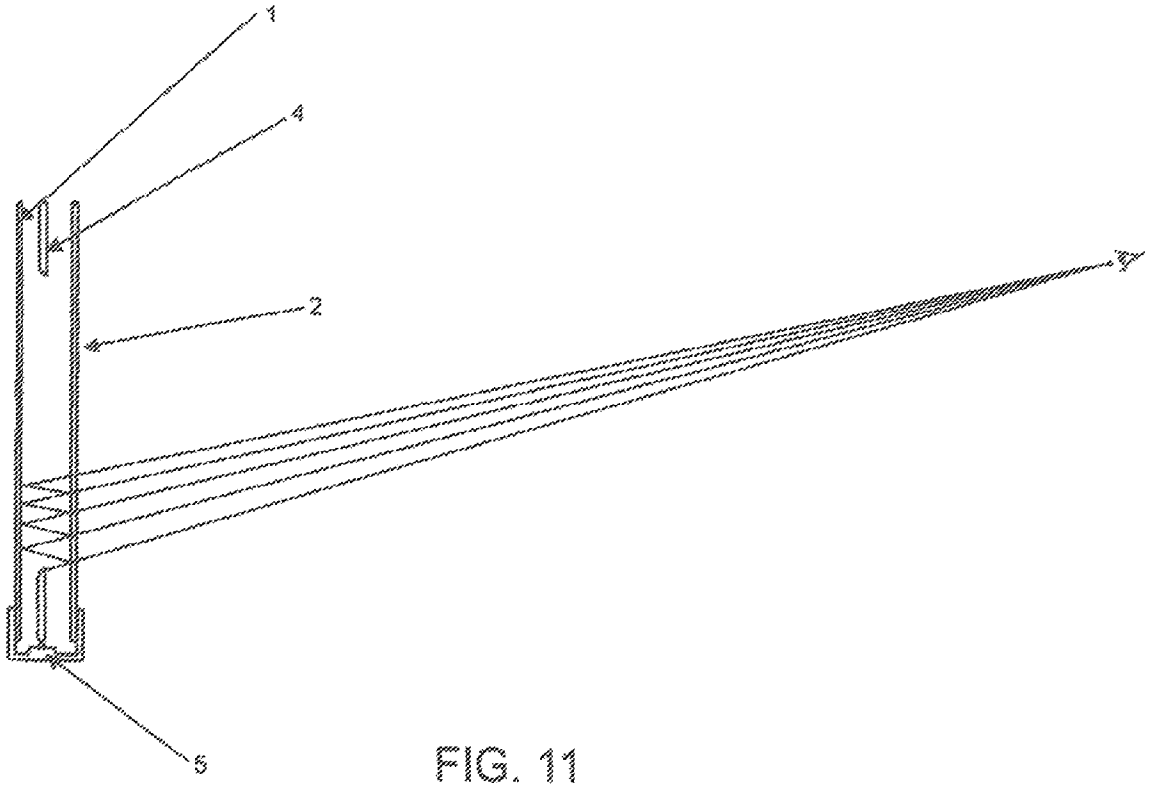

FIG. 11 shows a schematic cross-section of a device according to the invention comprising a plane mirror 1, a semi-transparent mirror 2, and LEDs (not shown) in accordance with the subjects of FIGS. 2,4, 6, and 8, among others, together with a curtain 4 for the diffusion of the light emitted by an LED or a set of LEDs 5 (e.g., in the form of an LED PCB, which is a set of LEDs available under this name and familiar to a person ordinarily skilled in the related art).

Figure 12:
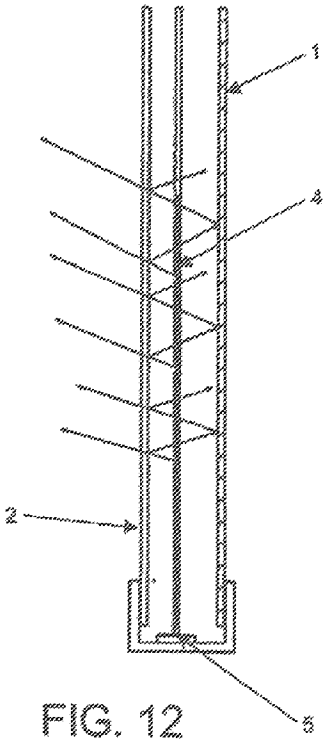

FIG. 12 shows a schematic cross-section of a device according to the invention comprising a plane mirror 1, a semi-transparent mirror 2, and LEDs (not shown) in accordance with the subjects of FIGS. 2, 4, 6, and 8, among others, together with a curtain 4 for the diffusion of the light emitted by an LED or a series of LEDs 5 (e.g., in the form of an LED PCB, which is a series of LEDs available under this name and familiar to a person ordinarily skilled in the related art) whereas the curtain 4 is provided with a motif that, when the curtain is lit by the LED or LEDs 5, generates a motif "in relief".

Figure 13:
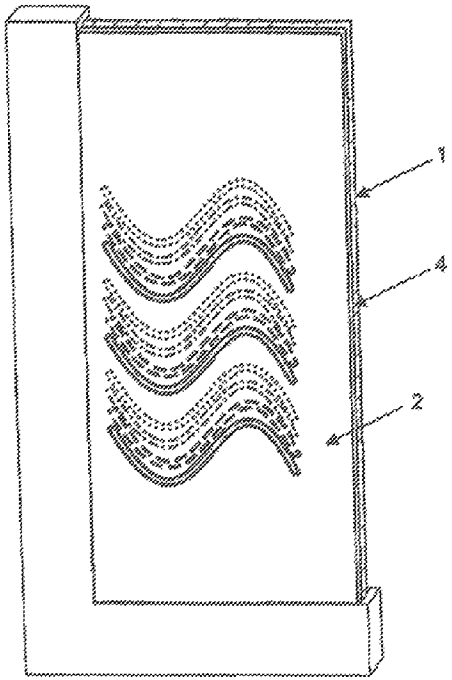

FIG. 13 shows a schematic perspective view of a module according to the invention comprising a mirror 1, semi-transparent mirror 2, light curtain 4 (substantially the foil surface of which can be lit by an appropriate LED or set of LEDs), and pattern (the frontal, view generating a particularly attractive "relief" effect on each of the patterns). Under suitable lighting and horn an appropriate viewing angle, the module may, thus, generate a "relief" image of the type represented in FIG. 13.

DETAILED DESCRIPTION OF EMBODIMENTS OF INVENTION

With reference to the drawing described briefly above (specifically FIGS. 11-13 thereof that illustrate the device), but not by way of limitation, the device according to the invention comprises a mirror 1 and semi-transparent mirror 2 with LEDs 3 that are appropriately powered and oriented for the emission in the direction perpendicular to the mid-plane of the mirror 1 of light rays that are partially reflected by the semi-transparent mirror 2 and partially transmitted through, the latter.

Figure 2:
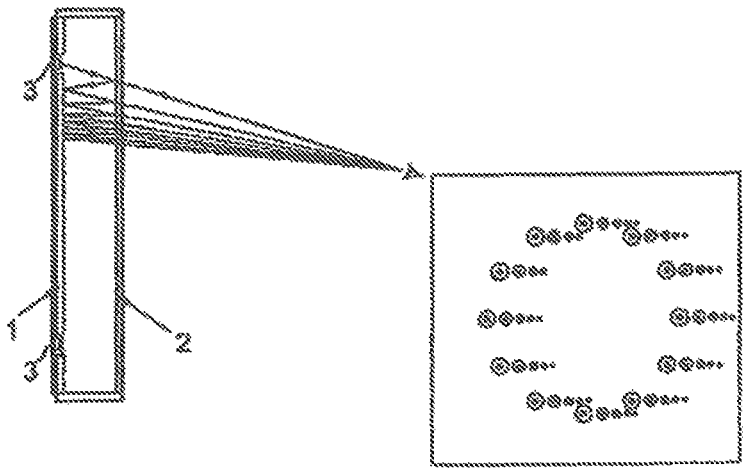
FIG. 2 shows a schematic view with an "observation" point that lies outside the optical axis of one of the LEDs.

According to FIG. 2, it can be seen that an approximate loss of 50% is associated with each reflection from the semi-transparent mirror.

Figure 1:
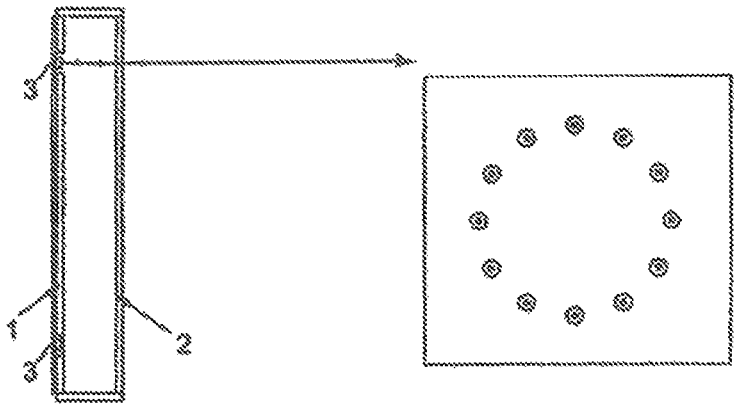
FIG. 1 shows a schematic cross-section of a sub-assembly comprising a plane mirror 1 and semi-transparent plane mirror 2 (T~50%, R~50%) together with LEDs 3. The box on the right represents the light images seen by an observer situated in the position indicated.

According to FIG. 1, when the observer is positioned in the axis of the LED or at infinity, the observer does not see multiple reflections.

Figure 3:
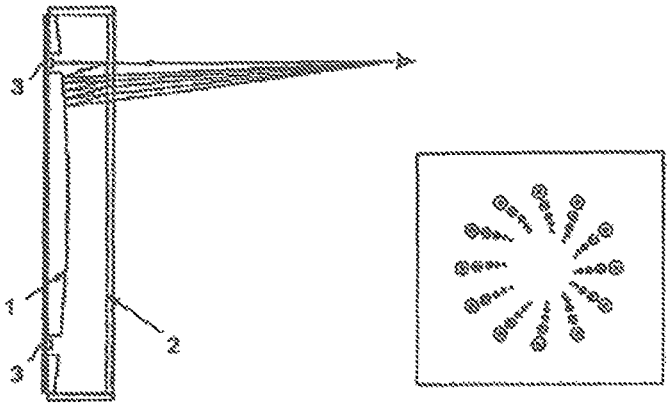
FIG. 3 shows a schematic cross-section of a sub-assembly comprising a spherical mirror 1 and semi-transparent plane mirror 2 (T~50%, R~50%) together with LEDs 3. The box on the right represents the light images seen by an observer situated in the optical axis of one of the LEDs.
Figure 4:
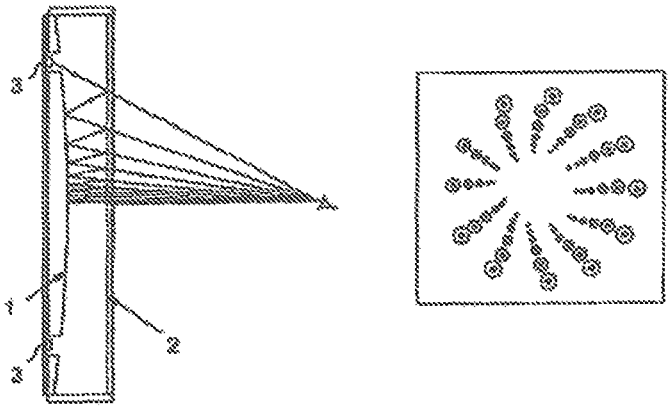
FIG. 4 shows a schematic view in accordance with FIG. 3 with an "observation" point that lies outside the optical axis of one of the LEDs.

According to FIGS. 3 and 4 (the effect of depth changes according to the viewing angle), the multiple reflections are more closely or widely spaced apart.

According to FIG. 3, the effect of depth, is the same as that associated with FIG. 4. However, when the observer is positioned in the axis of the LED or at infinity, the observer still sees multiple reflections due to the presence of the spherical mirror 1.

Figure 5:
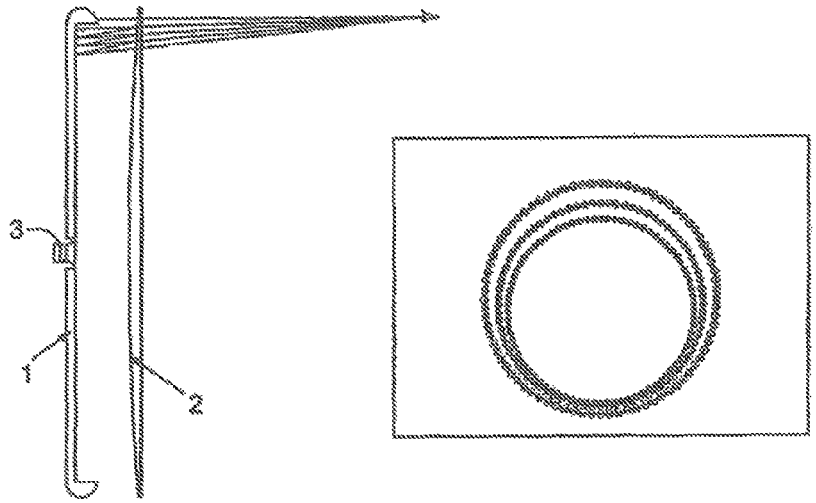
FIG. 5 shows a schematic cross-section of a sub-assembly comprising a curtain-mirror 1 and semi-transparent spherical mirror 2 (T~50%, R~50%) together with LEDs 3. The box on the right represents the light images seen by an observer situated in the light-output axis.
Figure 6:
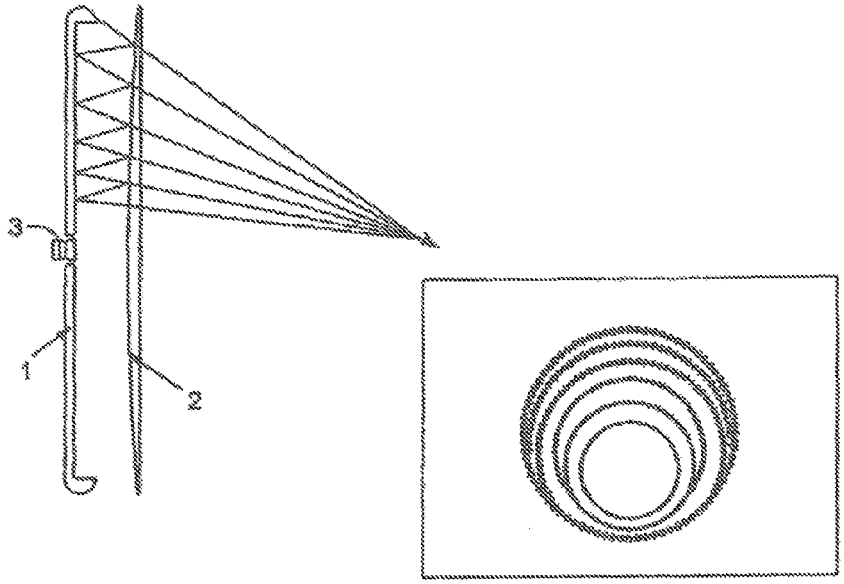
FIG. 6 shows a schematic view in accordance with FIG. 1 with an "observation" point that lies outside the light-output axis.

According to FIGS. 5 and 6 (the effect of depth changes according to the viewing angle), the multiple reflections are more closely or widely spaced apart.

According to FIGS. 7, 8 and 9, the distance, between the images perceived by the observer becomes smaller as the distance "d" between the two mirrors is reduced.

FIG. 10 ("*a*," "*b*," and "*c*") shows a spectacular representation of the effects achieved with the respective devices deployed.

The complete assembly (illustrative examples of which are shown in FIGS. 11-13) makes it possible to reveal (upon lighting by the LED or LEDs that diffuse their light in the curtain) patterns selected by design and integrated/applied within and/or the curtain.

In an embodiment, one LED 3 or more of the LEDs 3 may be omitted or switchable such that the "infinity" effect is reserved to the images of the patterns carried by the curtain 4.

The device generates an infinite number of images only 7 to 12 of which, on average, are visible to the human eye.

In the device, the light source (comprised of the LED or LEDs for the lighting of the screen and diffusion of distributed light within the latter) reveals one pattern, or more patterns that are engraved on this screen or embedded within the screen. It is this diffused light that is then subject to successive reflections of the mirror 1 and/or semi-transparent mirrors 2, which generates a remarkably attractive image of the pattern(s) with an "infinity" effect.

The device is principally intended to serve as any one or combination of "side" light, "position" light, "brake" light, "indicator" light, etc. for both the front and rear of vehicles, according to context. The device may also be used for the equipment of an exterior lighting device (such as a lateral repeater) and/or a system for the interior lighting of a vehicle passenger compartment.

The invention has been described above in an illustrative manner. It is to be understood that the terminology that has been, used above is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A device for at least one of a signaling light and lighting either of an exterior and interior ambient of a motor-vehicle passenger compartment including at least one type of light source, the device comprising:

an optical assembly of at least one first reflector including a mirror (1) and at least one second reflector including a semi-transparent mirror (2); and a curtain diffuser (4) of a substantially transparent material in which light emitted by at least one LED (3) is diffused, the current diffuser extending between the mirror and the semi-transparent mirror with substantially the same extension as those, the planes or mid-planes of the mirror (1), the semi-transparent mirror (2), and the curtain diffuser (4) being mutually substantially parallel, wherein light transmitted or reflected by the optical assembly is transmitted and visible to an observer from a surface of the second reflector that is substantially opposite to a surface facing the other elements of the optical assembly and the curtain diffuser (4) comprises one or more patterns that are embedded in the curtain diffuser and includes a lighting sub-assembly arranged between the mirror (1) and semi-transparent mirror (2) and made of a transparent optical material and having at least one light source (5) arranged for emission of a plurality of rays of light propagated within a thickness of the transparent optical material for illuminating the patter within the curtain diffuser.

2. The device as set forth in claim 1, wherein the device is integrated or suitable for integration in a housing in a general form of a substantially cylindrical section to constitute a module.

3. The device as set forth in claim 1, wherein at least one of the second reflector and curtain diffuser is arranged in front of the LED.

4. The device as set forth in claim 1, wherein the transparent optical material includes a plate having at least one bilateral and extended convex projection, of substantially circular overall cross-section, defining a substantially median longitudinal axis in a substantial mid-plane of the plate, and adapted to form a light guide and at least one LED arranged at at least one end of the light guide and defining a main orthogonal axis in a longitudinal axis of the light guide.

5. The device as set forth in claim 1, wherein the of planes or mid-planes of the mirror and semi-transparent mirror are mutually parallel.

6. The device as set forth in claim 1, wherein the optical assembly is arranged substantially perpendicularly to an optical axis of a beam emitted by the LED.

7. The device as set forth in claim 1, wherein the mirror is arranged substantially next to the LEDs with a reflective surface of the mirror facing front, the mirror being substantially hollowed-out or non-existent next to the LEDs to allow the LEDs to project a light beam substantially in front of the mirror.

8. The device as set forth in claim 1, wherein the first reflector is semi-transparent and identical to the second reflector.

9. The device as set forth in claim 1, wherein the device comprises further a curtain diffuser that is combined with the mirror.

10. The device as set forth in claim 1, wherein the mirror is selected from any of a reflector, mirror proper, and semi-mirror and any of substantially plane, conical, elliptical, semi-elliptical, hyperbolic, spiral, logarithmic spiral, and helical.

11. The device as set forth in claim 10, wherein the mirror is provided with variable curvature, including variations within respective zones of the mirror.

12. The device as set forth in claim 1, wherein an additional optical system is arranged substantially between the two mirrors and provides a light source that is substantially parallel to the other light sources for provision of the signaling light.

13. The device as set forth in claim 1, wherein the device functions as a side light with an initial substantial ring of LEDs arranged in a substantial circle around a substantially central point and a brake light delivering a stronger intensity and "relief" effect from substantially a base of the device.

14. The device as set forth in claim 1, wherein at least one of the mirrors is substantially spherical.

15. The device as set forth in claim 1, wherein the LED is supplemented by at least one substantially 16-watt axial-filament lamp.

16. At least one of a signaling and lighting module for either of an exterior and interior of a motor vehicle, wherein the module comprises:

at least one device for at least one of a signaling light and lighting an ambient of either of the exterior and interior of a passenger compartment of the motor vehicle including at least one type of light source, wherein the device comprises:

an optical assembly of at least one first reflector including a mirror (1) and at least one second reflector including a semi-transparent mirror (2); and a curtain diffuser (4) of a substantially transparent material in which light emitted by at least one LED (3) is diffused, the planes or mid-planes of the mirror (1), the semi-transparent mirror (2), and the curtain diffuser (4) being mutually substantially parallel, wherein light transmitted or reflected by the optical assembly is transmitted and visible to an observer from a surface of the second reflector that is substantially opposite to that facing a plurality of other elements of the optical assembly and the curtain diffuser (4) includes a lighting sub-assembly arranged in space between the mirror (1) and semi-transparent mirror (2) and having a substantially transparent optical material and at least one light source (5) arranged for emission of a plurality of rays of light propagated within a thickness of the transparent optical material.

17. The module as set forth in claim 16, wherein an additional optical system is arranged between the two mirrors and provides a light source that is substantially parallel to other light sources for provision of the signaling light.

* * * * *